US005562807A

United States Patent [19]

Baluha

[11] Patent Number: 5,562,807

[45] Date of Patent: Oct. 8, 1996

[54] CROSS DIRECTION FIBER MOVEMENT AND DEWATERING DEVICE

[76] Inventor: Mark R. Baluha, 5690 Hackett Rd., Saginaw, Mich. 48603

[21] Appl. No.: 397,783

[22] Filed: Mar. 3, 1995

[51] Int. Cl.[6] ..... D21F 1/48

[52] U.S. Cl. ..... 162/352; 162/374; 162/209

[58] Field of Search ..... 162/352, 374, 162/366, 354, 363, 364, 209

[56] References Cited

U.S. PATENT DOCUMENTS

| | | | |
|---|---|---|---|
| 3,446,702 | 5/1969 | Buchanan | 162/352 |
| 4,004,969 | 1/1977 | Beauchemin | 162/352 |
| 4,055,460 | 10/1977 | Buchanan | 162/209 |
| 4,123,322 | 10/1978 | Hoult | 162/352 |
| 4,420,370 | 12/1983 | Saad | 162/209 |
| 4,425,188 | 1/1984 | Fujiwara | 162/300 |
| 4,425,189 | 1/1984 | Mimura | 162/352 |
| 4,532,009 | 7/1985 | Nickerson | 162/351 |

FOREIGN PATENT DOCUMENTS

| | | | |
|---|---|---|---|
| 0241439A2 | 10/1987 | European Pat. Off. | 162/352 |

*Primary Examiner*—Donald E. Czaja
*Assistant Examiner*—Jose A. Fortuna

[57] ABSTRACT

An improved cross direction fiber movement and dewatering device for typical papermaking machinery comprised of a main body (22) typically made of ultra-high molecular weight polyethylene conventionally machined with vacuum orientation diagonal slots (30) with alternating flat support zones on the top of the unit, equal in relation to the machined vacuum slots (31). The device promotes fiber reorientation on x and y axis, or cross direction to the general flow patterns of the paper machine while dewatering the pulp slurry (20) and promoting improved paper qualities.

3 Claims, 7 Drawing Sheets

CROSS DIRECTION FIBER MOVEMENT AND DEWATERING DEVICE

BACKGROUND

1. Field of Invention

This invention relates to the production and application of a device for use in papermaking machinery, and more importantly, the improved performance of the pulp fiber slurry relating to the molecular level bonding and liquid drainage of the paper product.

2. Description of Prior Art

A multitude of dewatering devices are known, yet, typically such devices are positioned across the width of the paper machine, underneath the continuous moving screen that the pulp slurry is delivered onto from the extruder or headbox. These units are of two schools: (1) roll configuration or (2) foil configuration. Both types of configurations provide (a) support of the continuous screen and (b) remove liquid, mainly water, from the pulp slurry. These devices traverse the width of the papermaking machine perpendicular to the machine sides or rails. The roll devices are attached to the rails typically, while the foil devices are normally attached to equipment referred to as boxes which are, also, usually attached to the rail. Attachment of the devices to the rail holds them securely in place as the continuous screen is moved across the top of the units which initiates liquid removal from the pulp slurry.

Both configurations of devices have distinct characteristics and advantages in the papermaking process. The roll configuration creates what is referred to as a "pulse" of liquid, as the screen is moved across the unit, vacuum is created on the back or downstream side of the roll pulling liquid through the screen from the slurry, the liquid coheses to the roll and as the roll turns, literally, pushes liquid back up into the slurry on the from or upstream side of the roll at the contact point of the screen. This disturbance or "pulse" creates activity in the slurry at the fiber level and under controlled conditions seems to help formation. Because of the size and surface area of the roll, "pulse" is difficult to control and drainage of the liquid is adequate at best, especially, at higher machine speeds.

The foil configuration exhibits more efficient drainage characteristics than the roll configuration but slurry activity is diminished because less "pulse" is available. Current foil designs allow faster screen speeds over shorter distances because of increased drainage capabilities but formation or fiber bonding then becomes the issue.

The deficiencies of the current designs are: (1) cross direction fiber movement crucial to the optimal fiber bonding is inhibited as the liquid is removed, the fibers are forced down in straight lines. Poor formation is enhanced by current straight line drainage devices and techniques which often lead to streaking and marking and overall lower quality of the pulp product; (2) the continuous screen is supported on narrow points, the contact point of a roll or the nose portion of a foil; (3) often because of the straight line liquid removal, entire machine tables are moved back and forth or oscillated in an attempt to regain cross direction fiber movement and improve poor sheet formation. This movement is a massive undertaking. Because of the size of the equipment that is moved back and forth this motion is severely limited in speed and effectiveness. Often the entire sheet only realizes a tiny fraction of the overall movement of one or two inches; (4) Presently, the devices available are of one design or the other and provide only those characteristics that type employs and adjustment requires complete change to another device.

Objects and Advantages

Accordingly, besides the objects and advantages of the improved cross-direction fiber movement and dewatering device described above, several objects and advantages are:

(a) to provide an improved cross-direction fiber movement and dewatering device that promotes improved fiber bonding and improved overall formation of the paper product;

(b) to provide an improved cross-direction fiber movement and dewatering device that incorporates an adjustable field of movement and characteristics to aid in formation of the paper product and improve the papermaking process;

(c) to provide an improved cross-direction fiber movement and dewatering device with improved continuous screen support characteristics;

(d) to provide an improved cross-direction fiber movement and dewatering device that can be oscillated under the screen at infinitely variable speeds and strokes utilizing a motor and power unit independent of the machine or table;

(e) to provide an improved cross-direction fiber movement and dewatering device with improved liquid drainage characteristics while promoting favorable cross machine mass movement of the pulp fibers to improve overall sheet quality;

(f) to provide an improved cross-direction fiber movement and dewatering device that employs advantages and characteristics preferred at an adjustable and non-disruptive manner to the papermaking process.

Further objects and advantages will become apparent from a consideration of the ensuing description and drawings.

Figure 1:
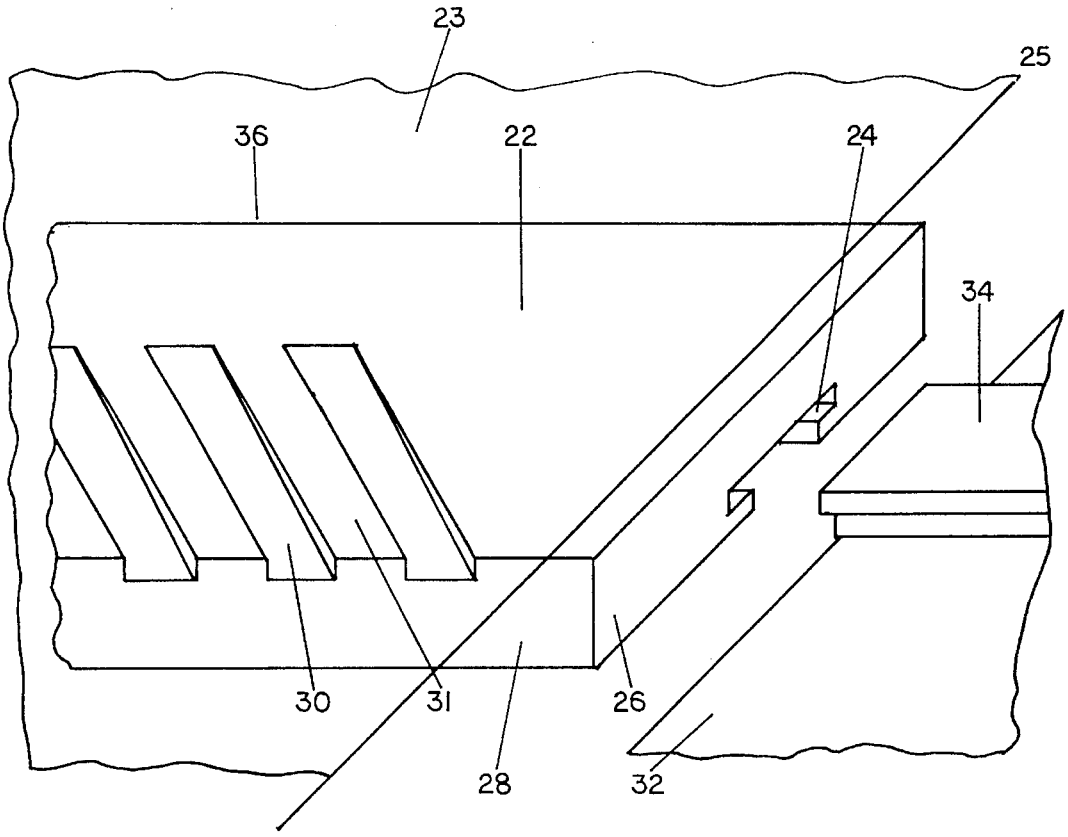
FIG. 1 shows a top end view from the back side of the cross direction formation enhancement unit.

Reference Numerals in Drawings 20 pulp slurry 22 main blade body 23 continuous conveyor or machine wire 24 machined T-slot or dovetail 25 flow direction of pulp slurry 26 short side end of unit 27 top front fiat in front of the machined vacuum slot 28 short back or lead out side 30 machined vacuum fiber orientation slot in a multitude of shapes and sizes 31 alternating flats on top of unit, equal in relation to machined slots 32 box or equipment the T-bar or dovetail rail is fixed to 33 oscillator cam 34 T-bar or dovetail fixed to box or equipment used to secure blade 35 shaft or push rod between cam and hydraulic oscillator motor 36 front short angled lead in side 37 hydraulic oscillator motor 38 liquid removed by front angled edge of blade 39 cpu controlled needle valve 40 liquid removed by vacuum fiber orientation slots 41 hydraulic power source to drive oscillator motors 42 controls, valves, and cpu to control speed and thrust of oscillation

DESCRIPTION OF THE PREFERRED EMBODIMENTS

Referring more specifically to the drawings, FIG. 1 illustrates the end back side view. A typical cross direction formation enhancement unit of the present invention—commonly referred to as the "blade" or "unit".

Figure 2:
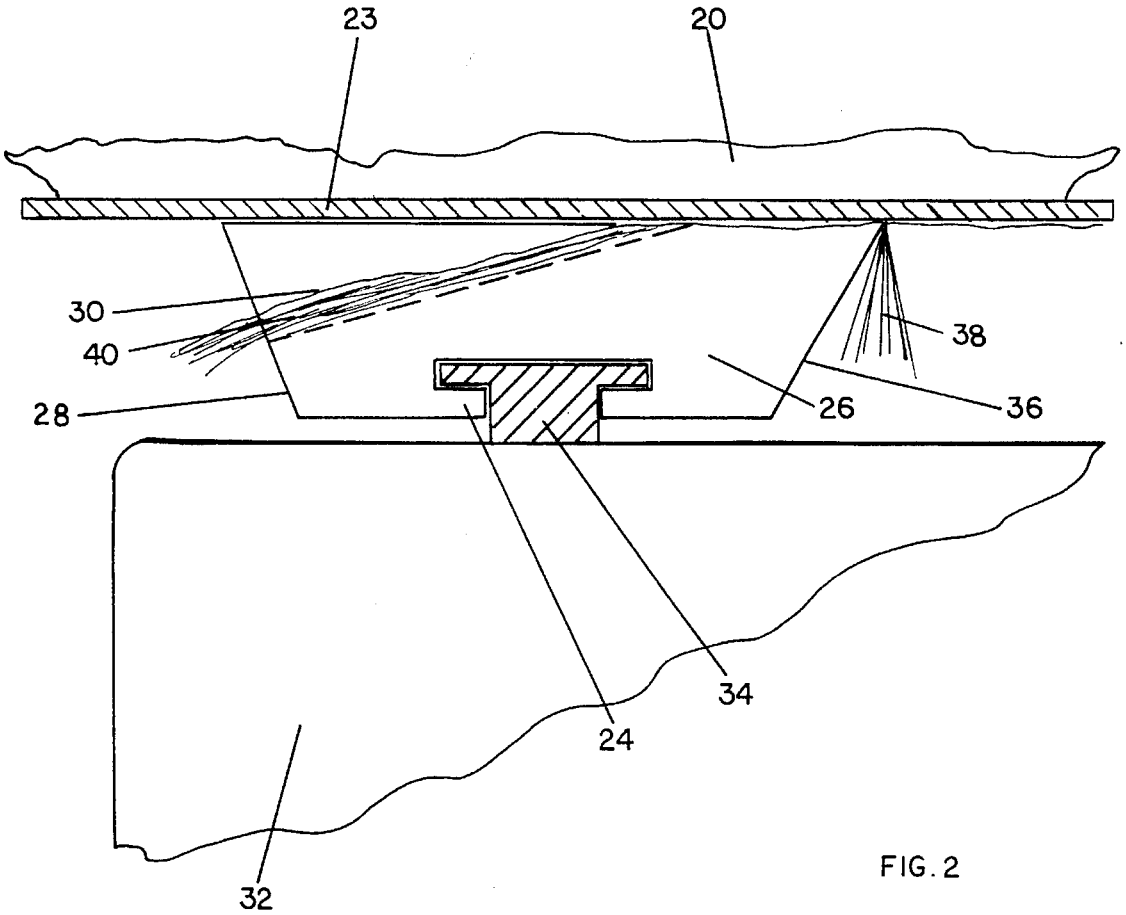
FIG. 2 shows an end view of the cross direction formation unit and the typical mounting attachment by one method, the t-bar and equipment box. The action of the unit is depicted in this fig. showing drainage of the water, at the front edge of the unit and the action of the back slots.
Figure 3:
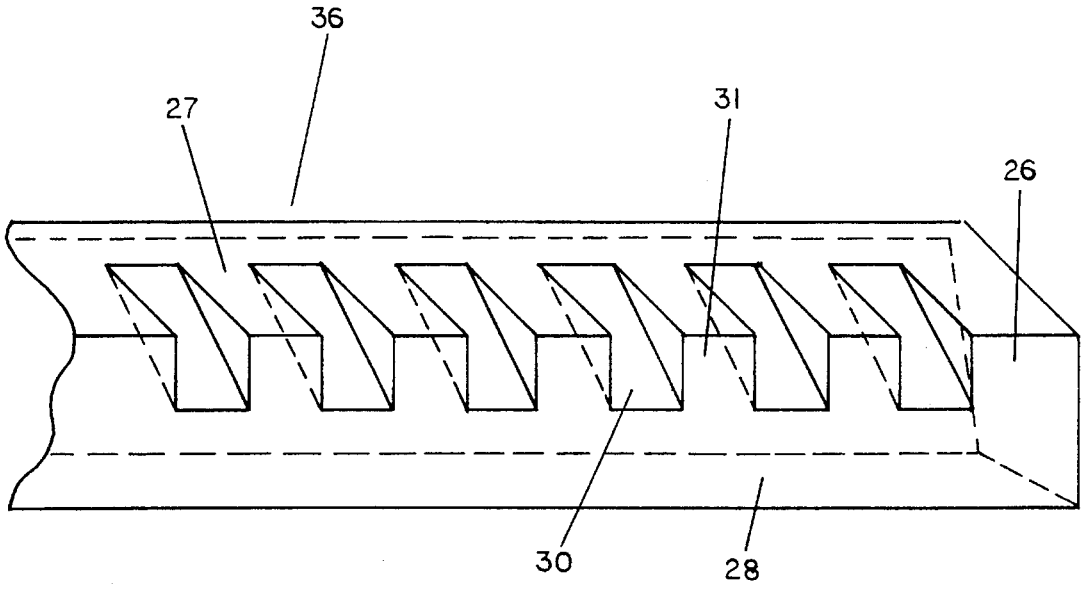
FIG. 3 shows a back view of the unit and the standard configuration of the machined slots
Figure 4:
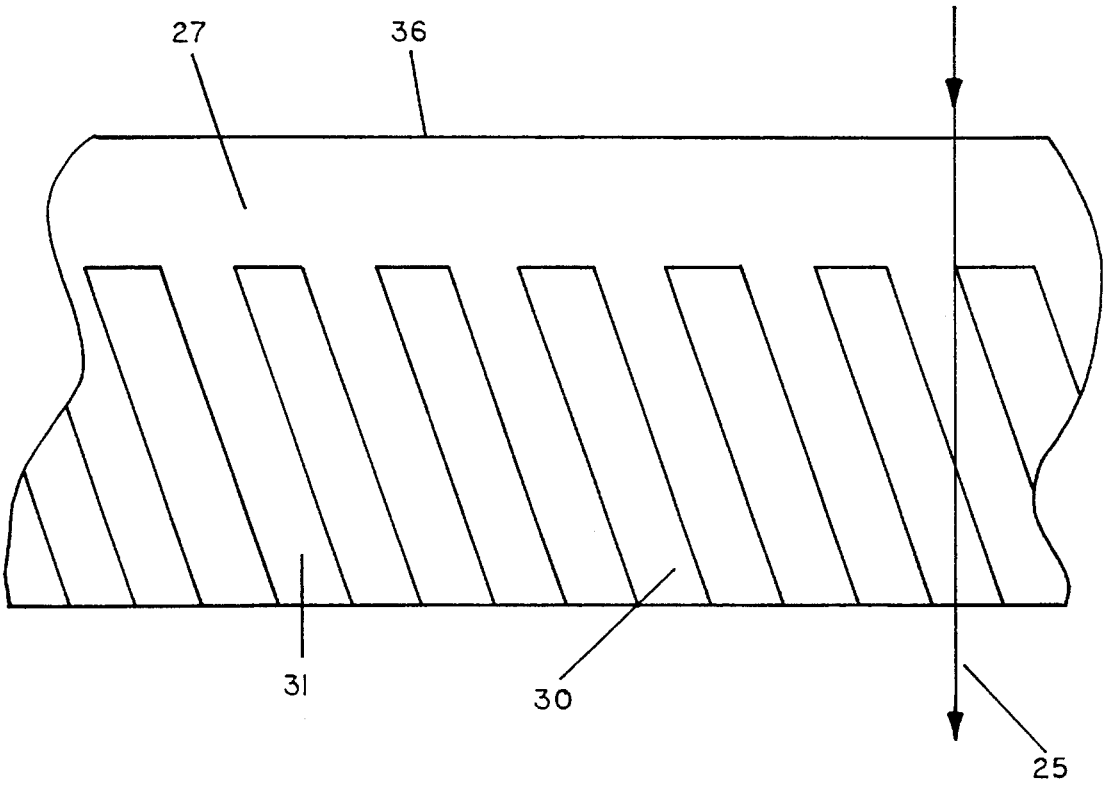
FIG. 4 shows the top view of the standard configuration of the machined slots and alternating flats.
Figure 5:
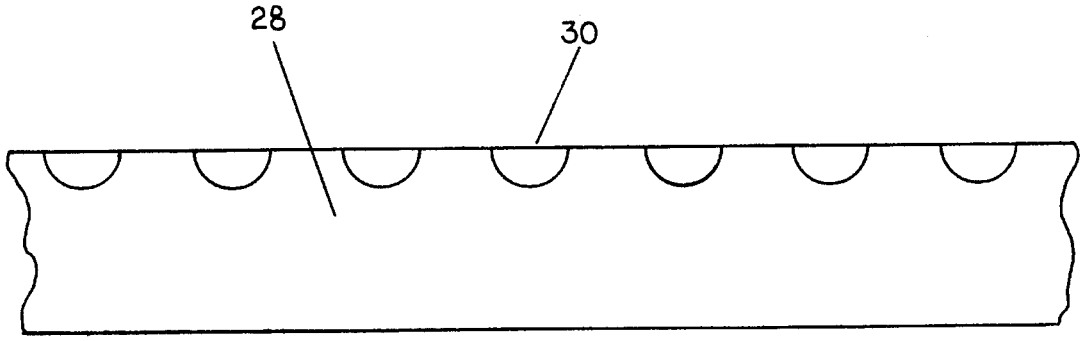
FIG. 5 shows the back view of the unit and round slot configuration.
Figure 6:
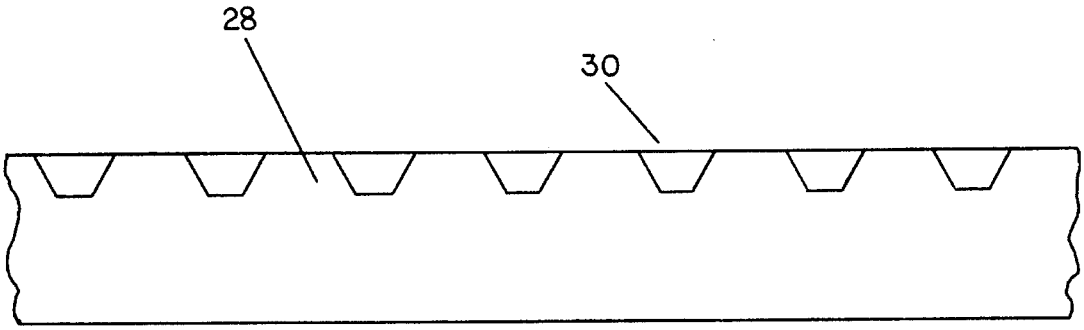
FIG. 6 shows the back view of the unit and trapezoidal slot configuration.

In use, typically, FIG. 1 and FIG. 2, the main blade body (22) is made of ultra high molecular weight polyethylene (UHMW) measuring the length of the equipment the blade is to be utilized on, and, typically, 3–4 inches wide and 1 inch thick, which can be machined by conventional methods with a angled short lead-in edge (36), a T-slot or dovetail (24) is machined in the bottom of the blade to secure the unit to the existing T-bar or dovetail (34) on the equipment box (32) fixed to the paper machine. The top flat of the blade is machined with graduating slots, or vacuum fiber re-orientation slots (30) the machined alternating flats (31) are equal in relation to the machined slots (30). The wire or continuous conveyor (23) is moved across the top of the blade as illustrated in FIG. 2, the pulp slurry (20) is carried by the conveyor (23) and the actions and design of the blade creates drainage of the liquid (38) on the short angled front edge (36) and as the conveyor is moved across the blade over the machined slots (30) vacuum is formed in the graduated angled slot, removing liquid (40) and reorienting the fibers in the slurry (20) to promote more tightly woven bond and a more closed sheet. The blade is attached as shown in FIG. 2 to the machine via a T-bar or dovetail (34) which securely fixes the blade in place. FIG. 3 and FIG. 4 show the machined vacuum fiber reorientation slot (30) in the typical square configuration in relation to the short back side (28) and the top front lead-in flat before the machined slot (27). Also FIGS. 1–4 show an elongate rectangular body having a top flat surface (22) in contact with the bottom surface of the forming fabric or wire (23), a bottom, a leading edge, a trailing edge, and two substantially equal short elongated side walls (36) and (28), one of said two short side walls (36) including said leading edge and the other of said two short side walls (28) including the trailing edge. A plurality of equally spaced and sized diagonal slots (30) are disposed in a downstream portion along the top flat surface (22) of the elongated rectangular body to form alternating equally spaced flats (31) and slots (30) in the elongated direction of the device. The slots (30) are in diagonal relationship to the longitudinal direction and each slot has a bottom, a front end, and a back end, the bottom of each slot extending at an angle towards the trailing edge such that the front end of the slot defines a closed end and the back end of the slot defines an open end at the short side wall trailing edge of the rectangular body, the open end allows excess liquid to be drained and the closed end creates vacuum as the forming fabric is moved over the device. Two active drainage zones are created, one on the leading edge and one on the diagonal slots on the top flat surface, promoting improved cross machine fiber orientation properties. FIG. 5 and FIG. 6 show two different slot configurations, round slot (30) and trapezoidal slot (30) configurations in the relation to the short back side (28).

Figure 7:
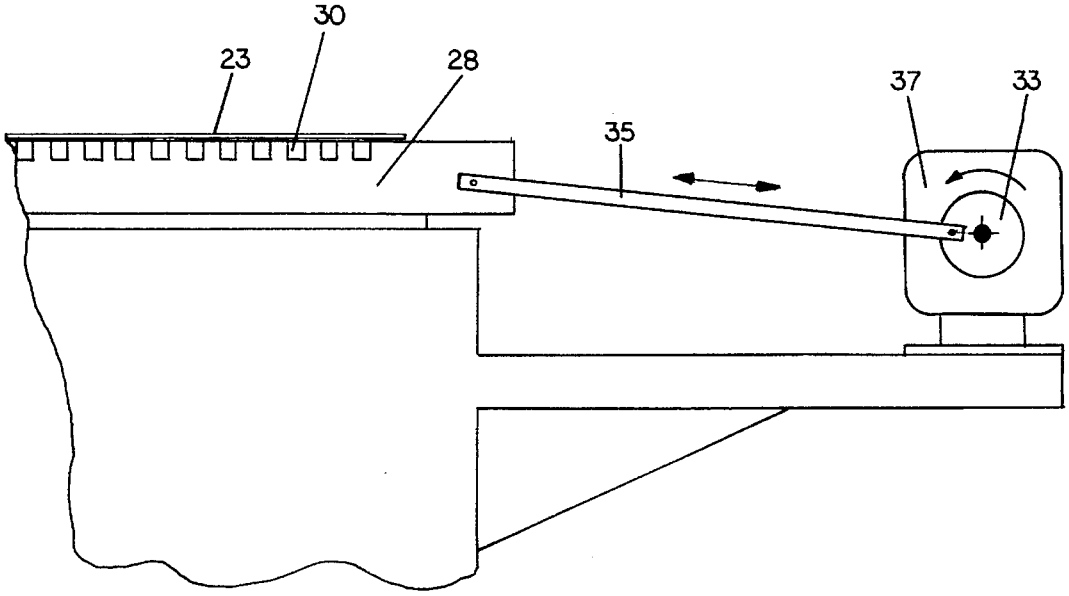
FIG. 7 shows the back view of the cross direction formation unit attached to one type of cam and shaft oscillation unit.
Figure 8:
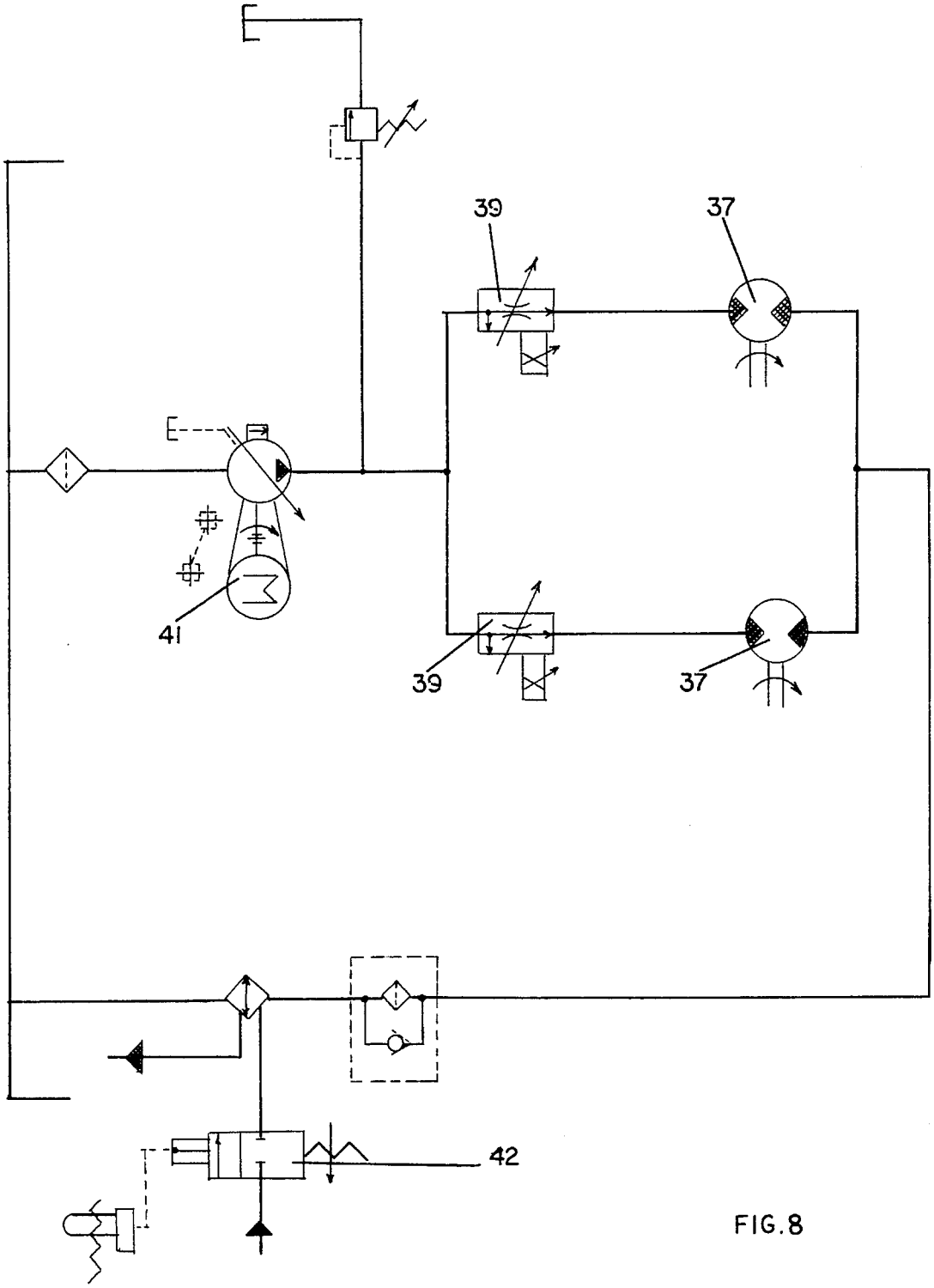
FIG. 8 shows the schematic for the cross direction formation enhancement units hydraulic drive power unit for oscillating the units on the papermachine.

FIG. 7 illustrates one type of oscillator unit utilizes a hydraulic motor (37) with a cam (33) of a determined size to regulate stroke of the shaft (35) and overall movement of the blade (22). FIG. 8 illustrates the preferred remote power source for the hydraulic motors (37) where the speed of the stroke is regulated by needle valves (39) that are controlled by the controller, valve and cpu (42) which also controls the hydraulic motor pump (41).

Summary, Ramifications, and Scope

Briefly, the present invention comprises an improved cross-direction fiber movement and dewatering device for use in papermaking machinery employing the use of precisely located slots or grooves in the top downstream edge of the units. These slots are machined or molded to promote fiber movement perpendicular to the flow while providing improved drainage and liquid removal. Slots are equally spaced typically ½" apart and equally sized ½" wide to provide consistent flow and drainage. The top surface of the unit is flat or 0 degrees providing improved screen support and longer life characteristics. Device width is typically 4" but can be wider or narrower. Slots are, typically, machined ¾" from the top upstream or lead in edge and are on an angle, typically, 20 degrees of perpendicular to length of the device. The unit extends the full width of the screen on the machine. The slots are then graduated on a 3 degree drainage angle either into or with the flow of the slurry. Typically a t-slot is machined on the bottom center of the device to allow it to be secured on the machine and yet the unit can be oscillated back and forth under the screen or removed or replaced while the machine is operating. A motor and power unit is located at the back or driveside of the machine where a cam and push rod assembly can be attached to the end of the device. The cross-direction fiber movement and dewatering device is then moved back and forth under the moving screen. The speed of the oscillation and length of stroke are then determined by the speed, weight and particular machine requirements for enhanced cross direction mass fiber movement. In a preferred embodiment the unit is manufactured of a strong, wear resistant, light weight and non-abrasive material such as ultra high molecular weight polyethylene or a high wear resistant material such as an industrial ceramic, i.e. alumina oxide. The power unit or oscillator for the device is typically a hydraulic power source to drive the motor and cam allowing for long term reliability and sealed remote non-electric power because the extreme wet or water environment associated with the papermaking process. Cam size on the motor determines the length of the stroke of the device, normally, the cam is 1 inch off center for a 2 inch stroke length.

Figure 9:
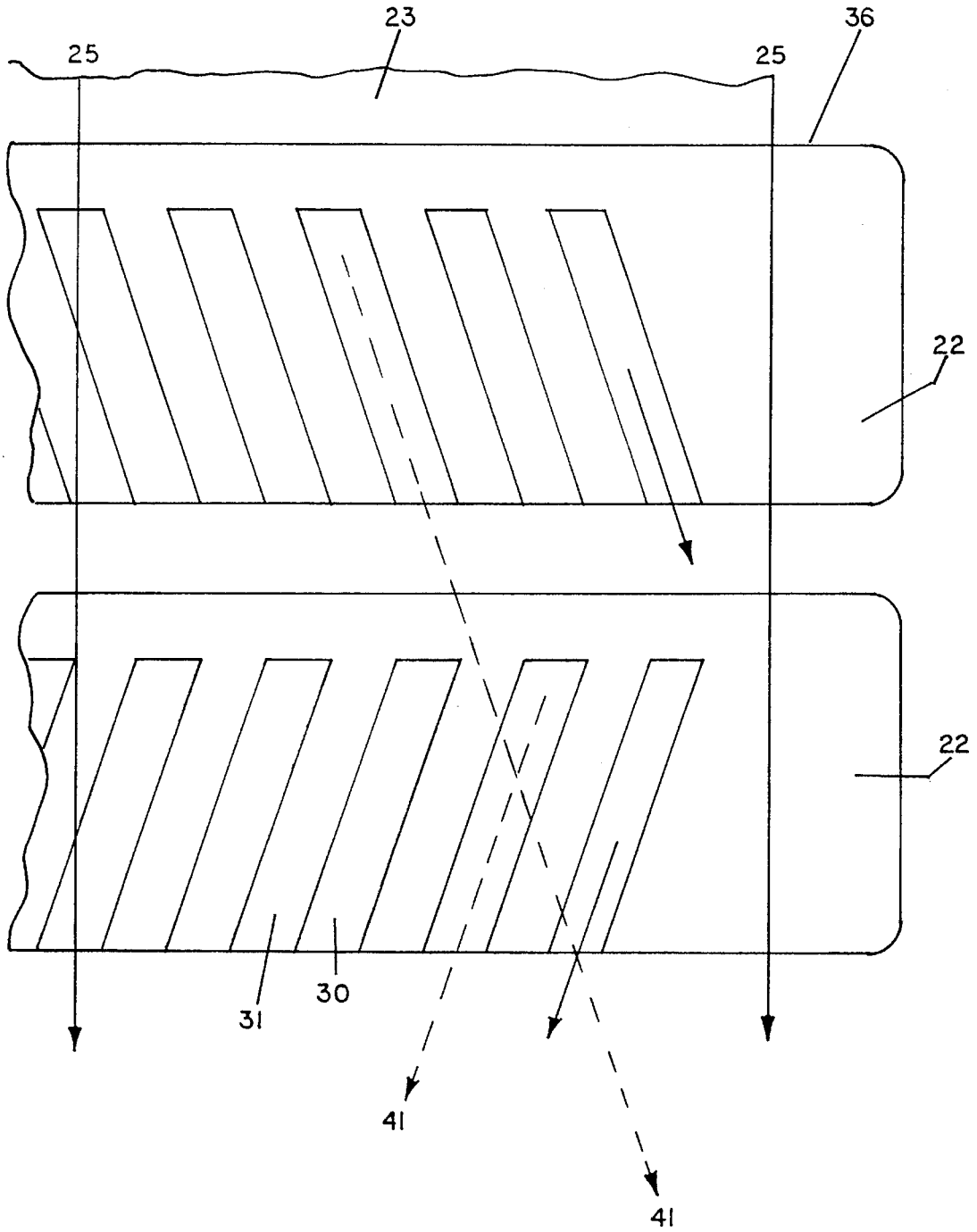
FIG. 9 shows the top view of the cross machine direction formation enhancement device, one set of left and right preferred grouping with related wire and machine direction and depiction of crossing fiber patter and movement.

The improved cross-direction fiber movement and dewatering devices can be left and right handed in relation to the 20 degree slot and utilized in pairs, alternating left to right to left to right etc., as shown in FIG. 9, in order to maintain the harmonic balance of the machine and promote back and forth mass fiber movement and oscillation dynamics.

The power unit counter oscillates the individual devices in order to accentuate the mass fiber movement with minimal power and effort and allowing larger variance in stroke speed. Cam operation is also in pairs although the stroke is counter balanced also to maintain critical machine harmonics and promote optimum controlled cross machine fiber activity and overall improved sheet quality.

Although the description above contains many specificities, these should not be construed as limiting the scope of the invention but as merely providing illustrations of some of the preferred embodiments of the invention. For example, this product can have other shapes such as square or trapezoidal etc.. The slots can be circular, square, triangular etc., or the unit can be manufactured out of materials such as rubber (an elastomeric material) or alumina oxide (a metallurgical material). Also, size, shape and length can be modified. Thus the scope of the invention should be determined by the appended claims and their legal equivalents rather by the examples given.

I claim:

1. In combination with a forming section of a papermaking machine having a moving endless forming fabric extending in a longitudinal direction on a surface of which is flowed a slurry of papermaking fibers, a dewatering blade device comprising;

a) an elongate rectangular body having a top flat surface in contact with the bottom surface of the forming fabric, a bottom, a leading edge, a trailing edge, and two substantially equal short elongated side walls, one of said two short side walls including said leading edge and the other of said two short side walls including the trailing edge;

b) a plurality of equally spaced and sized diagonal slots disposed in a downstream portion along said top flat surface of said elongated rectangular body to form alternating equally spaced flats and slots in the elongated direction of the device, said slots are in diagonal relationship to said longitudinal direction, each slot having a bottom, a front end, and a back end, the bottom of each slot extending at an angle towards the trailing edge such that the front end of the slot defines a closed end and the back end of the slot defines an open end at the short side wall trailing edge of said elongated rectangular body, the open end allows excess liquid to be drained and the closed end creates vacuum as the forming fabric is moved over the device, and;

c) a variably controlled motor and power unit to oscillate said elongated body to increase cross machine fiber movement, wherein;

d) two active drainage zones are created, one on said leading edge and one on said diagonal slots on said top flat surface, promoting improved cross machine fiber orientation properties.

2. The device of claim 1, wherein the cross section of said diagonal slots in the cross machine direction is a semicircle.

3. The device of claim 1, wherein the cross section of said diagonal slots in the cross machine direction is square.

* * * * *